United States Patent [19]

Itzov

[11] Patent Number: 4,634,320

[45] Date of Patent: Jan. 6, 1987

[54] DRILL STAND LOCK

[75] Inventor: Andrew L. Itzov, Menomonee Falls, Wis.

[73] Assignee: Milwaukee Electric Tool Corporation, Brookfield, Wis.

[21] Appl. No.: 750,170

[22] Filed: Jul. 1, 1985

[51] Int. Cl.[4] ..... E21C 11/00

[52] U.S. Cl. ..... 408/136; 408/129; 408/712; 248/410

[58] Field of Search ..... 408/129, 136, 712; 248/410

[56] References Cited

U.S. PATENT DOCUMENTS

| | | | |
|---|---|---|---|
| 836,303 | 11/1906 | Christensen | 248/410 |
| 1,674,081 | 7/1925 | Adams | 248/410 |
| 2,629,267 | 2/1953 | Hart | 408/712 |
| 2,879,678 | 3/1959 | Kaiser, Jr. | 408/712 |
| 3,539,142 | 11/1970 | Morand | 248/410 |
| 4,442,905 | 4/1984 | Agoston | 408/712 |

FOREIGN PATENT DOCUMENTS

| | | | |
|---|---|---|---|
| 126404 | 10/1949 | Sweden | 248/410 |

*Primary Examiner*—John Sipos
*Assistant Examiner*—Donald R. Studebaker
*Attorney, Agent, or Firm*—Bayard H. Michael

[57] ABSTRACT

The stand for a portable power drill has a base supporting an upright column on which a clamp is mounted for slideable movement to a desired height where it is fixed. A carriage is slideably mounted on the column with a bushing on each side of the clamp. A spring biases the carriage upwardly. A power drill is clamped on the carriage and the carriage can be moved downwardly relative to the clamp against the bias of the spring to feed the drill bit into the work. A lock plate having an aperture slightly larger than the diameter of the column fits over the column and is spring biased to tilt on a fulcrum on the underside of the clamp. When tilted, the aperture edges engage ("and bite") the column to support the carriage and drill. The plate has a pad which is depressed against the spring bias to release the plate so the clamp and carriage can be raised or lowered.

7 Claims, 5 Drawing Figures

DRILL STAND LOCK

BACKGROUND OF THE INVENTION

Stands for portable electric drills enable using the drill somewhat like a drill press. The drill is fixed on a carriage movable on the column relative to a vertically adjustable clamp on the column. The clamp is secured in the desired position and the carriage is biased away from the work and moved towards the work by actuating a feed handle. To adjust the clamp position on the column requires two hands; one hand to hold the carriage and drill in position while the other hand tightens or loosens the clamp.

The object of this invention is to enable one-handed adjustment of the drill/clamp position without risk of the drill falling and being damaged.

SUMMARY OF THE INVENTION

This invention provides a drill stand having a base supporting an upright column on which a clamp is mounted for slideable movement to a desired height where it is fixed. A carriage is slideably mounted on the column with a bushing on each side of the clamp. A spring biases the carriage upwardly. A power drill is clamped on the carriage and the carriage can be moved downwardly relative to the clamp against the bias of the spring to feed the drill bit into the work. A lock plate having an aperture slightly larger than the diameter of the column fits over the column and is spring biased to tilt on a fulcrum on the underside of the clamp. When the plate is tilted, the aperture edges engage (and "bite") the column to support the carriage and drill. The plate has a pad which is depressed against the spring bias to release the plate so the clamp and carriage can be raised or lowered.

DETAILED DESCRIPTION OF THE DRAWINGS

Figure 1:
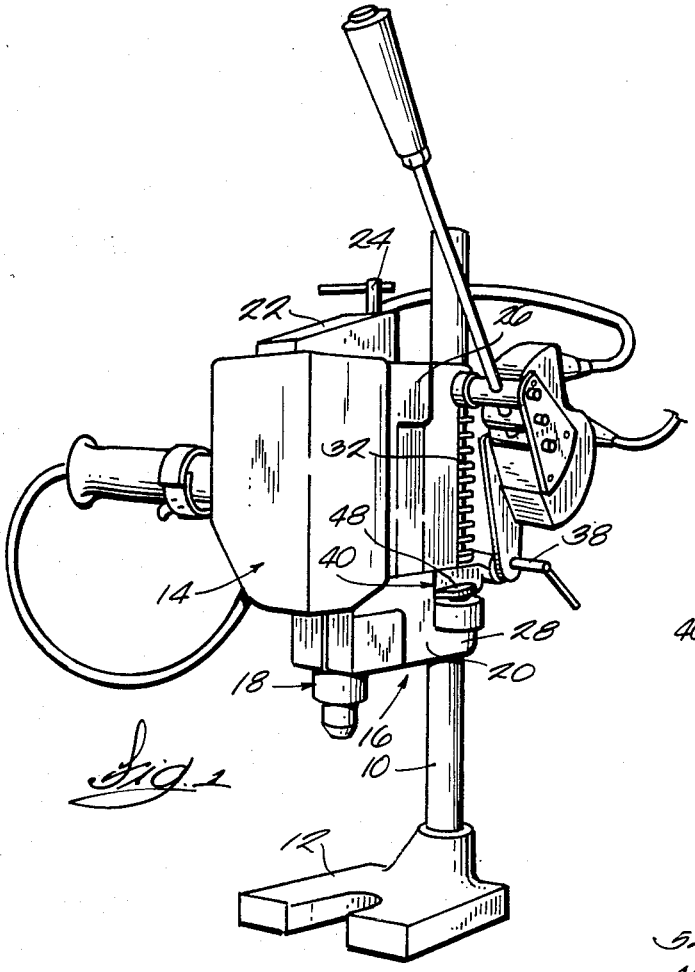
FIG. 1 is a perspective view of the drill stand.
Figure 3:
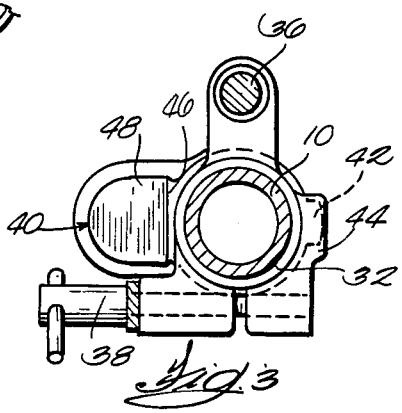
FIG. 3 is a horizontal section through the column just above the clamp and the thumb pad for actuating the lock plate.
Figure 4:
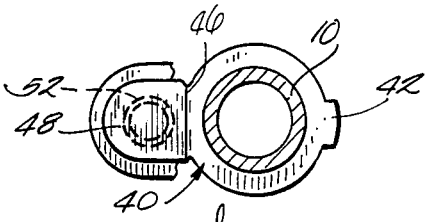
FIG. 4 is a horizontal section through the column to show details of the lock plate.
Figure 2:
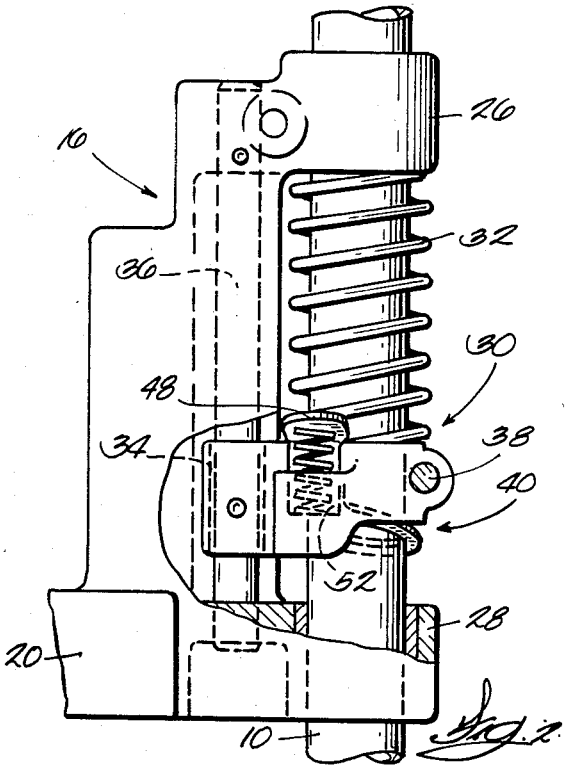
FIG. 2 is an enlarged partial side elevation of the column, carriage and clamp.
Figure 5:
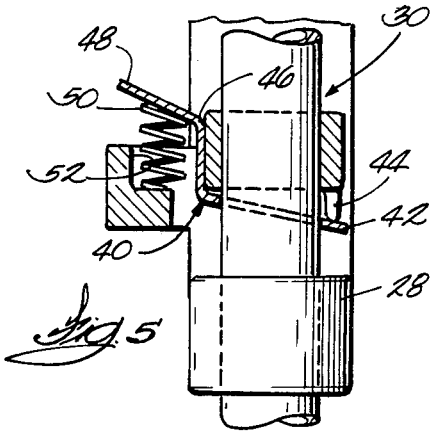
FIG. 5 is a vertical section showing details of the lock plate.

The drill stand has a column 10 fixed in base 12 which can be secured to a bench or the like. Other bases can be used to fix the column to various supports. The drill 14 is secured to carriage 16 to position the drive spindle and chuck 18 vertically. The drill is clamped between support 20 and the follower 22 which is tightened by screw 24. The carriage has spaced arms 26, 28 which straddle clamp 30 and have bushings sliding on the column 10. Spring 32 encircles the column and is compressed between clamp 30 and arm 26 to bias the carriage upwardly to the inactive position with the arm 28 engaging the underside of the clamp.

The clamp 30 has a bushing 34 sliding on guide rod 36 and has a split collar encircling column 10. Screw 38 is manually tightened to close the collar on the column or to release the collar. The construction to this point is generally old. With such construction (and without the present invention) it is apparent the user must support the drill and carriage whenever the clamp is released. That is a two-hand operation.

The improved clamp includes a clamp lock 40 having a hole slightly larger than the diameter of the column over which the lock fits. The lock has a tab 42 which projects under fulcrum or finger 44 depending from the clamp 30. The lock also has an opposed portion 46 which projects upwardly outside the clamp and then projects outwardly to form a pad 48 which overlies spring 50. The spring 50 is compressed between pad 48 and the bottom of well 52 projecting laterally from the clamp for easy manual access. The user's thumb falls on the pad naturally.

The spring 50 cocks the lock plate 40 on the column by pivoting the plate about finger 44. The weight of the drill and carriage sets up a force couple acting clockwise on the lock plate while the plate engages the column to set up an opposing couple which also includes the force of spring 50. Since the opposing couple includes the spring force, the opposing couple is always greater than the first couple.

This arrangement ensures the lock plate engages the column with a force great enough to prevent the carriage and drill from sliding down the column. Assuming the clamp screw has been backed off, the carriage and drill can be released for movement up or down the column by depressing pad 48 to disengage the lock plate from the column. This is a one-handed operation. When the carriage is at the desired height, the pad 48 is released and the lock plate will retain the carriage in position. The clamp screw can then be tightened—it should be tightened since the upward force on the drill through the bit and the drive spindle could push the carriage up on the column. The big advantage with this arrangement is that the carriage and drill need not be supported by one hand while the other loosens the clamp screw or slides the rig on the column or tightens the clamp. The former two-handed operation is a single-handed operation.

The pad 48 is larger than the spring well. Normally, the pad never reaches the edge of the spring well 52 since the plate is disengaged from the column before that.

I claim:

1. A stand for supporting a portable power drill for operation in the manner of a drill press, comprising a base a column supported by and projecting upwardly from said base, a clamp slideably mounted on said column and including means fixing said clamp on said column at a desired height, a carriage slideably mounted on said column and including a bushing on each side of said clamp, a first spring biasing said carriage to a raised position relative to said clamp, means operative to move said carriage downwardly against the bias of said spring, a lock plate having a hole slightly larger than the diameter of said column and fitting over said column adjacent said clamp, a fulcrum fixed relative to said clamp and engaging said plate so the plate can tilt about said fulcrum, a second spring biasing said plate to tilt said plate to engage the edge of the hole in the plate with the column, said plate being moveable against the bias of said second spring to disengage said plate from said column to enable said clamp to be moved up or down said column if said clamp is released from said column.

2. A drill stand according to claim 1 in which said second spring is compressed between said clamp and said plate and said plate moves with said clamp.

3. A drill stand according to claim 1 in which said carriage includes a guide which cooperates with said clamp.

4. A drill stand according to claim 3 in which said first spring encircles said column and seats against said clamp and the upper carriage bushing.

5. A drill stand according to claim 4 in which said clamp has a split ring portion fitting over said column and includes screw means for drawing said portion together, said lock plate being operative to support said carriage and drill on said column when said screw means has been operated to release said clamp.

6. A drill stand according to claim 1 in which said plate includes a pad positioned for easy access by an operator, said second spring being compressed between said pad and said clamp, said pad being depressed against the bias of said second spring to release said plate from said column.

7. In combination with a drill stand of the type having a column, a clamp slideable on said column, screw means for fixing said clamp on said column, a carriage having a bushing on each side of said clamp and slideably mounted on said column for movement relative to said clamp, a spring biasing said carriage to an inactive position, and means operative to control movement of the carriage, the improvement comprising, lock means carried by said clamp and engageable with said column, spring means biasing said lock means into engagement with said column to secure said clamp to said column independently of said screw means, said lock means being moveable against the bias of said spring means to a position in which said lock means is disengaged from said column to allow movement of said clamp on said column.

* * * * *